US008187359B2

(12) United States Patent
Tokuda et al.

(10) Patent No.: US 8,187,359 B2
(45) Date of Patent: May 29, 2012

(54) GRANULATED METALLIC IRON SUPERIOR IN RUST RESISTANCE AND METHOD FOR PRODUCING THE SAME

(75) Inventors: Koji Tokuda, Kobe (JP); Osamu Tsuge, Kobe (JP)

(73) Assignee: Mesabi Nugget LLC, Silver Bay, MN (US)

( * ) Notice: Subject to any disclaimer, the term of this patent is extended or adjusted under 35 U.S.C. 154(b) by 692 days.

(21) Appl. No.: 12/282,187

(22) PCT Filed: Mar. 24, 2006

(86) PCT No.: PCT/US2006/011095

§ 371 (c)(1),
(2), (4) Date: Sep. 9, 2008

(87) PCT Pub. No.: WO2007/111593

PCT Pub. Date: Oct. 4, 2007

(65) Prior Publication Data

US 2009/0068488 A1 Mar. 12, 2009

(51) Int. Cl.
*C21B 13/10* (2006.01)
*C22B 1/16* (2006.01)

(52) U.S. Cl. ..... 75/484; 75/770; 148/287

(58) Field of Classification Search ..... 148/287; 75/770–772

See application file for complete search history.

(56) References Cited

U.S. PATENT DOCUMENTS

| | | | | |
|---|---|---|---|---|
| 1,690,378 | A * | 11/1928 | Rinck | 148/287 |
| 3,549,425 | A * | 12/1970 | Broussard et al. | 428/341 |
| 3,617,394 | A * | 11/1971 | Mayer | 148/287 |
| 3,923,506 | A | 12/1975 | Bergfjord et al. | |
| 4,622,905 | A | 11/1986 | MacDougall et al. | |
| 6,241,803 | B1 | 6/2001 | Fuji | |
| 2003/0019329 | A1 | 1/2003 | Sugitatsu et al. | |
| 2003/0019548 | A1 | 1/2003 | Miyagawa et al. | |

FOREIGN PATENT DOCUMENTS

| | | |
|---|---|---|
| JP | 3 268842 | 11/1991 |
| JP | 7-42523 | 5/1995 |
| JP | 2001-255068 | 9/2001 |
| JP | 2002-194412 | 7/2002 |
| TW | 1233845 | 6/2005 |

OTHER PUBLICATIONS

Magnetite. (n.d.). Dictionary.com Unabridged. Retrieved Jul. 20, 2011, from Dictionary.com website: http://dictionary.reference.com/browse/magnetite.*

Office Action issued Dec. 7, 2011, in Japanese Patent Application No. 20090501397, filed Mar. 24, 2006 (w/English translation).

* cited by examiner

*Primary Examiner* — George Wyszomierski
*Assistant Examiner* — Tima M McGuthry Banks
(74) *Attorney, Agent, or Firm* — Oblon, Spivak, McClelland, Maier & Neustadt, L.L.P.

(57) ABSTRACT

An object of the present invention is to provide a method for producing granulated metallic iron superior in rust resistance. Another object of the present invention is to provide a method for producing such granulated metallic iron. In the method, the granulated metallic iron is produced by agglomerating a material mixture including an iron-oxide-containing material and a carbonaceous reducing agent; charging and heating the agglomerated material mixture in a moving hearth-type reducing furnace to reduce the iron oxide in the material mixture with the carbonaceous reducing agent to obtain hot granulated metallic iron; and cooling the hot granulated metallic iron, wherein the hot granulated metallic iron is cooled while its relative position is changed; and an oxide coating is formed on the surface of the hot granulated metallic iron by bringing moisture into contact with almost the entire surface of the hot granulated metallic iron.

15 Claims, No Drawings

GRANULATED METALLIC IRON SUPERIOR IN RUST RESISTANCE AND METHOD FOR PRODUCING THE SAME

This application is a continuation of PCT International Application PCT/US06/11095, filed Mar. 24, 2006, designating the United States, for which Applicant claims the benefit of priority under 35 U.S.C. §120.

TECHNICAL FIELD

The present invention relates to technologies for producing granulated metallic iron by agglomerating a material mixture including an iron-oxide-containing material and a carbonaceous reducing agent and heating the agglomerated material mixture in a moving hearth-type reducing furnace, and more specifically, relates to technologies for preventing the granulated metallic iron from rusting.

BACKGROUND ART

With respect to relatively small scale iron-manufacturing of a wide variety of products in small quantities, a method has been developed for producing granulated metallic iron by agglomerating a material mixture including an iron-oxide-containing material (iron source) such as iron ore and a carbonaceous reducing agent such as coal, heating the agglomerated material mixture in a moving hearth-type reducing furnace for solid reduction, and cooling produced hot granulated metallic iron while separating them from slag generated as a by-product. The hot granulated metallic iron is cooled in a cooler to where the hot granulated metallic iron is transferred by a feeder from the moving hearth-type reducing furnace. The inside of the cooler is indirectly cooled by a flow of water over the exterior surface. The hot granulated metallic iron fed into the cooler is cooled while its relative position is changed during its passage through the inside of the cooler, and then is discharged from the cooler as granulated metallic iron.

The temperature of the hot granulated metallic iron at the time it is fed into the cooler is about 900 to 1000° C. The hot granulated metallic iron is cooled to about 150° C. in the cooler and then is discharged from the cooler. In the case that the temperature of the granulated metallic iron when it is discharged from the cooler is higher than 150° C., red rust tends to be generated on the surface of the granulated metallic iron by the reaction of moisture in the air with the granulated metallic iron. Therefore, in order to adequately cool the hot granulated metallic iron in the cooler, the total length of the cooler must be enlarged or the time the hot granulated metallic iron takes to pass through the cooler must be extended by decreasing the passing speed of the hot granulated metallic iron. However, facility development is necessary for the enlargement of the total length of the cooler and as a consequence, the facility scale is expanded. Thus, space cannot be saved. Furthermore, the decrease in the passing speed of the hot granulated metallic iron in the cooler decreases the productivity. Additionally, the increase in the temperature of the inside of the cooler might be prevented by increasing the water amount flowing over the exterior surface of the cooler, but the decrease in the temperature achieved by increasing the water amount is negligible.

Meanwhile, the resulting granulated metallic iron after the cooling may be left outdoors due to the imbalance in supply and demand. When the granulated metallic iron is left to stand for a long period of time, red rust may occur on the surface of the granulated metallic iron. The occurrence of red rust degrades the appearance of the granulated metallic iron thus decreasing the commercial value. Furthermore, the iron source is consumed with the occurrence of red rust; which leads to loss of the iron source. Thus, granulated metallic iron which is highly resistant to red-rusting has been desired.

Japanese Unexamined Patent Application Publication No. 3-268842 previously filed by the present applicants does not relate to a technology for preventing the occurrence of red rust in granulated metallic iron produced by a moving hearth-type reducing furnace, but provides a method for producing pig iron for casting. This patent application discloses that the occurrence of red rust can be prevented by forming a coating of magnetite on the surface of the pig iron by cooling foundry pig iron using mist or water vapor. However, the pig iron demolded from a casting mold is piled up on a carriage, and mist or water vapor is applied to the pig iron in this condition. Therefore, in this technology, the entire surface of the iron pig cannot be prevented from red-rusting.

DISCLOSURE OF INVENTION

The present invention has been accomplished under such circumstances. An object of the present invention is to provide granulated metallic iron superior in rust resistance, and another object is to provide a method for producing such granulated metallic iron.

The method for producing granulated metallic iron according to the present invention can resolve the above-mentioned problems. In the method, the granulated metallic iron is produced by agglomerating a material mixture including an iron-oxide-containing material and a carbonaceous reducing agent; charging and heating the agglomerated material mixture in a moving hearth-type reducing furnace to reduce the iron oxide in the material mixture with the carbonaceous reducing agent to produce hot granulated metallic iron; and cooling the hot granulated metallic iron, wherein the hot granulated metallic iron is cooled while its relative position is changed; and an oxide coating is formed on the surface of the hot granulated metallic iron by bringing moisture into contact with almost the entire surface of the hot granulated metallic iron.

In the method according to the present invention, the oxide coating is formed on the surface of the hot granulated metallic iron by bringing moisture into contact with the hot granulated metallic iron produced by reduction in the moving hearth-type reducing furnace. The thus produced granulated metallic iron is superior in rust resistance due to the oxide coating formed on the surface of the granulated metallic iron and is prevented from red-rusting even if it is left to stand for a long period of time. Additionally, in the method according to the present invention, moisture applied to the hot granulated metallic iron draws heat from the hot granulated metallic iron when the moisture evaporates. Therefore, the hot granulated metallic iron is efficiently cooled. As a consequence, for example, a facility space can be decreased by shortening the total length of the cooler, or the productivity can be improved by increasing the passing speed of the hot granulated metallic iron through the cooler.

BEST MODE FOR CARRYING OUT THE INVENTION

The inventors have studied for providing granulated metallic iron which is highly resistant to red-rusting so that red rust negligibly occurs even if the granulated metallic iron is stored by leaving them standing in the air for a long period of time. As a result, it has been found that the occurrence of red rust can be prevented by previously forming an oxide coating on the surface of the granulated metallic iron. Furthermore, it has been found that the granulated metallic iron having such an oxide coating can be readily produced by bringing moisture into contact with almost the entire surface of the hot granulated metallic iron, produced in a moving hearth-type reducing furnace, when it is cooled. Thus, the present invention has been accomplished.

The granulated metallic iron being highly resistant to red-rusting according to the present invention has an oxide coating formed on its surface. The granulated metallic iron can be prevented from the occurrence of the red rust with the oxide coating formed on its surface, even if the granulated metallic iron is left to stand.

When the thickness of the oxide coating is too small, the anti-rusting effect is hardly provided and red rust occurs on the surface of the granulated metallic iron when it is left to stand in an oxidizing atmosphere. Therefore, the average thickness of the oxide coating is, but not limited to, preferably 3 μm or more, and more preferably 5 μm or more. The rust resistance is increased with the thickness of the coating. However, the granulated metallic iron is an intermediate material and consequently the period for which the granulated metallic iron is left to stand is one to two months at the longest even if it is stored. The occurrence of the red rust may be prevented for at least such a period. Therefore, an average thickness of about 10 μm is sufficient and about 20 μm at the thickest.

The thickness of the oxide coating is measured by examining ten points of a cross section of granulated metallic iron in the vicinity of the surface with a scanning electron microscope at ×400, and the average thickness is calculated.

The main constituent of the oxide coating is magnetite ($Fe_3O_4$), which is known as black rust and is passivated to prevent the occurrence of red rust. Here, the term "main constituent" means the oxide coating contains 90 percent by mass or more of the constituent, i.e., magnetite, as determined by X-ray diffraction analysis of the component composition of the oxide coating.

The oxide coating is preferably formed so as to cover 95% or more of the entire surface of the granulated metallic iron. When the coverage by the oxide coating is low, red rust occurs at the portions not covered with the oxide coating. The granulated metallic iron of which the entire surface is covered with the oxide coating is most preferable.

Such granulated metallic iron can be produced by the following method: the oxide coating can be formed on the surface of the granulated metallic iron by cooling the hot granulated metallic iron reduced in a moving hearth-type reducing furnace while its relative position is changed; and bringing moisture into contact with almost the entire surface of the hot granulated metallic iron when the hot granulated metallic iron is cooled.

Namely, the oxide coating is formed on the surface of the hot granulated metallic iron by a reaction of the moisture with the hot granulated metallic iron when the moisture is brought into contact with the hot granulated metallic iron. At this time, since the heat of the hot granulated metallic iron is drawn by the sensible heat and evaporation heat of the moisture by the contact of the hot granulated metallic iron with the moisture, the hot granulated metallic iron is efficiently cooled. As a result, for example, the total length of the cooler can be shortened or the residence time of the hot granulated metallic iron in the cooler can be reduced.

It is also important to change relative position of the hot granulated metallic iron when it is brought into contact with the moisture. By changing the relative position of the hot granulated metallic iron, the moisture can be brought into contact with almost the entire surface of the hot granulated metallic iron and consequently the oxide coating can be uniformly formed over the entire surface of the hot granulated metallic iron.

The relative position of hot granulated metallic iron means the position relative to the inner bottom of the cooler. Specifically, it means a case in which the position of hot granulated metallic iron shifts in the longitudinal direction of the cooler and a case in which the position of hot granulated metallic iron shifts in the vertical direction to the inner bottom of the cooler. For example, when moisture is brought into contact with the hot granulated metallic iron under a condition that the hot granulated metallic iron is retained at a particular portion in the cooler without the relative position of the hot granulated metallic iron being changed, the moisture is brought into contact with only a part of the surface of the hot granulated metallic iron. Therefore, the oxide coating is non-uniformly formed, and the entire surface of the hot granulated metallic iron cannot be prevented from the occurrence of red rust.

In this regard, however, it is difficult to definitely bring moisture into contact with the entire surface of all the hot granulated metallic iron charged into the cooler for forming the oxide coating even if the hot granulated metallic iron is brought into contact with the moisture while its relative position is changed. Therefore, in the method according to the present invention, in order to bring moisture into contact with almost the entire surface of the hot granulated metallic iron, the method is preferably designed as described below. Here, the term "almost entire surface" means the nearly all surface of the hot granulated metallic iron. Moisture may be brought into contact with the hot granulated metallic iron so that the oxide film is formed to cover 95% or more of the surface of the hot granulated metallic iron. Most preferably, the moisture is brought into contact with the entire surface of the hot granulated metallic iron.

It is preferable to cool the hot granulated metallic iron while its direction, in addition to its relative position, is changed in order to form the oxide coating on almost the entire surface of the hot granulated metallic iron. By turning over the hot granulated metallic iron and changing the direction of the hot granulated metallic iron, the hot granulated metallic iron can change its portion where the moisture comes into contact with.

In order to cool the hot granulated metallic iron while its relative position is changed and to bring the moisture into contact with almost the entire surface of the hot granulated metallic iron, a rotary cooler, an oscillating cooler, and a pan-conveying cooler can be used, for example.

In the rotary cooler, the internal wall surface of the cooler rotates around the central axis. The rotary cooler rotates at a rate of about 0.5 to 4 rpm, and the relative position of the hot granulated metallic iron charged in the rotary cooler is changed in the vertical direction by the rotation of the internal wall surface. Furthermore, the hot granulated metallic iron is cooled while moving from the upstream side to the downstream side in the cooler by designing the rotary cooler such that the bottom at the downstream side is lower in height than that at the upstream side.

The oscillating cooler is provided with a vibratory plate, and the hot granulated metallic iron is charged on the vibratory plate. The relative position of the hot granulated metallic iron charged on the vibratory plate is changed by vibrating the vibratory plate. Additionally, the hot granulated metallic iron charged on the vibratory plate is cooled while moving from the upstream side to the downstream side in the cooler by designing the vibratory plate such that the vibratory plate at the downstream side is lower in height than that at the upstream side.

The pan-conveying cooler is provided with a conveyer having a feeding pan inside the cooler, and the hot granulated metallic iron is charged in the feeding pan. The hot granulated metallic iron charged in the feeding pan is cooled while its relative position is changed by the operation of the conveyer and by a function of a vibration generator which is provided if necessary. However, when the pan-conveying cooler is used, a large amount of water may be pooled in the feeding pan depending on the amount of the moisture which is brought into contact with the hot granulated metallic iron. Therefore, the feeding pan is preferably provided with a draining mechanism.

The rotary or oscillating cooler is preferably used. Since the directions of the hot granulated metallic iron is changed during its passage through the cooler by using the rotary or oscillating cooler, the surface of the hot granulated metallic iron can be brought into uniform contact with the moisture. In particular, the rotary cooler is most preferable.

Moisture may be brought into contact with the hot granulated metallic iron by any method, for example, by pouring (dispersion, jetting, etc.) moisture from above the hot granulated metallic iron.

Moisture may be brought into contact with the hot granulated metallic iron wherever the oxide coating can be formed on the surface of the hot granulated metallic iron when both are brought into contact with each other. For example, the hot granulated metallic iron charged in the cooler may be brought into contact with the moisture by supplying the moisture to the upstream side of the cooler or supplying the moisture to around the midstream or the downstream side of the cooler. The hot granulated metallic iron may be brought into contact with the moisture prior to the charging of the hot granulated metallic iron, produced by heat reduction in a moving hearth-type reducing furnace, into a cooler. Additionally, moisture may be supplied to the cooler simultaneously with the charging of the hot granulated metallic iron, produced by heat reduction in a moving hearth-type reducing furnace, into the cooler.

Here, the oxide coating is formed on the surface of the hot granulated metallic iron whose temperature is kept at 250° C. or more. When moisture is brought into contact with the hot granulated metallic iron cooled to lower than 250° C., the oxide coating is hardly formed. Preferably, moisture is brought into contact with the hot granulated metallic iron whose temperature is as high as possible. By bringing the moisture into contact with the hot granulated metallic iron of a high temperature, the oxide coating is readily formed and the thickness of the oxide coating increases in size, resulting in improvement of the rust resistance. Therefore, moisture is preferably brought into contact with the hot granulated metallic iron at the upstream side of the cooler in order to efficiently form the oxide coating. The upstream side is, for example, a region where the surface temperature of the hot granulated metallic iron is kept at 700° C. or more. Since such a region depends on the temperature of the hot granulated metallic iron when it is charged into a cooler and the cooling capacity of the cooler, the region cannot be equally defined. However, the hot granulated metallic iron is cooled to about 700° C. within several minutes after the charging of the hot granulated metallic iron into the cooler. When moisture is supplied to around the midstream or the downstream side of the cooler, the hot granulated metallic iron is further cooled. Therefore, the facility space can be decreased by shortening the total length of the cooler, or the productivity can be improved by increasing the passing speed of the hot granulated metallic iron in the cooler.

The amount of the moisture to be brought into contact with the hot granulated metallic iron is preferably 15 kg or more per ton of granulated metallic iron. When the amount of the moisture is lower than 15 kg per ton of the granulated metallic iron, the oxide coating is not sufficiently formed on the surface of the hot granulated metallic iron due to shortage of moisture. The amount of the moisture is preferably 20 kg or more per ton of the granulated metallic iron. The upper limit of the amount of the moisture is not specifically determined, but a larger amount of moisture does not necessarily form the oxide coating. Therefore, it is a waste of water. Additionally, when a large amount of moisture is used, the granulated metallic iron after the cooling is discharged from the cooler in a wet condition. This causes a difficulty in separation of the granulated metallic iron from slag or the like. Therefore, a drying process is additionally required. The amount of the moisture is preferably about 50 kg or less per ton of the granulated metallic iron. Furthermore, the amount of moisture to be brought into contact with the hot granulated metallic iron is preferably adjusted within the above-mentioned range so that the temperature of the granulated metallic iron when it is discharged from the cooler is about 150° C. or less.

The moisture condition when it is brought into contact with the hot granulated metallic iron is not specifically determined. Water (liquid) may be brought into contact with the hot granulated metallic iron, or water vapor may be brought into contact with the hot granulated metallic iron. Water vapor is preferably brought into contact with the hot granulated metallic iron because the oxide coating is thought to be formed by the contact of water vapor with heated granulated metallic iron. In other words, when water is brought into contact with the hot granulated metallic iron, it is thought that the water is vaporized near the surface of the hot granulated metallic iron due to the heat from the hot granulated metallic iron and then the oxide coating is formed by the contact of this vaporized water with the hot granulated metallic iron.

The cooler is preferably filled with an inert gas. This is because if oxygen is present in the atmosphere, red rust occurs before the formation of the oxide coating. Consequently, the cooler preferably has a sealing mechanism and is desirably constituted such that the atmosphere in the cooler can be controlled.

The hot granulated metallic iron can be produced by agglomerating a material mixture including an iron-oxide-containing material and a carbonaceous reducing agent; and charging and heating the agglomerated material mixture in a moving hearth-type reducing furnace to reduce the iron oxide in the material mixture with the carbonaceous reducing agent.

As regards the iron-oxide-containing material, any material can be used as long as the material contains iron oxide. Therefore, not only iron ore, which is most commonly used, but also by-product dust and mill scale discharged from an ironworks can be used, for example.

As regards the carbonaceous reducing agent, any carbonaceous agent can be used as long as it can exhibit the reducing activity. Examples of the carbonaceous agent include coal powder that is only treated with pulverization and sieving after mining; pulverized coke after heat treatment such as dry distillation; petroleum coke; and waste plastics. Thus, any carbonaceous reducing agent can be used regardless of their type. For example, blast furnace dust recovered as a waste product containing a carbonaceous material can be also used.

The fixed carbon content in the carbonaceous reducing agent is, but not limited to, preferably 60 percent by mass or more, more preferably 70 percent by mass or more.

The blending ratio of the carbonaceous reducing agent to the material mixture may be preferably equal to or higher than the theoretical equivalent weight necessary for reducing the iron oxide, but not limited to this.

When the material mixture is agglomerated, moisture is blended with the material mixture so that the material mixture is readily agglomerated. The term "agglomeration" means the forming of a simple compact by compression or the forming into a pellet, a briquette, or the like. The agglomerated material may be formed into an arbitrary shape, such as block, grain, approximately spherical, briquette, pellet, bar, ellipse, and ovoid-shapes, but not limited to these. The agglomeration process is performed by, but not limited to, rolling granulation or pressure forming.

The size of the agglomerated material is, but not limited to, preferably about 3 to 25 mm as an average particle size so that the heat reduction is uniformly performed.

The moisture content blended to the material mixture may be determined so that the material mixture can be agglomerated. For example, the moisture content is about 10 to 15 percent by mass.

Preferably, in order to improve the handleability, the strength of the agglomerated material, which is prepared by agglomerating the material mixture including the iron-oxide-containing material and the carbonaceous reducing agent, is increased by blending various binders (slaked lime, bentonites, carbohydrates, etc.).

The blending ratio of the binder is preferably 0.5 percent by mass or more to the material mixture. When the blending ratio is lower than 0.5 percent by mass, it is difficult to increase the strength of the agglomerated material. The blending ratio is more preferably 0.7 percent by mass or more. Higher blending ratio is preferable, but exceeding blending ratio raises production cost. Furthermore, it requires raising the amount of moisture, which causes a decrease in productivity due to extension of the drying time. Therefore, the blending ratio of the binder is preferably about 1.5 percent by mass or less, and more preferably 1.2 percent by mass or less.

The material mixture may further contain an additional component such as dolomite, fluorite, magnesium, or silica.

Then, the above-mentioned agglomerated material is dried until the moisture content decreases to about 0.25 percent by mass or less. The drying may be conducted by heating the agglomerated material at about 80 to 200° C., but the drying condition is not limited to this.

The dried agglomerated material is charged and heated in a moving hearth-type reducing furnace for reducing the iron oxide in the material mixture with the carbonaceous reducing agent to obtain hot granulated metallic iron.

The present invention will now be further described in detail with reference to the examples, but it should be understood that the examples are not intended to limit the invention. On the contrary, any modification in the range of the purpose described above or below is within the technical scope of the present invention.

Example 1

A material mixture composed of 16.8 percent by mass (dry mass) of coal powder as a carbonaceous reducing agent, 0.9 percent by mass (dry mass) of carbohydrate as a binder, 13 percent by mass of moisture, 72.9 percent by mass (dry mass) of an iron-oxide-containing material (iron ore powder), and 9.4 percent by mass (dry mass) of one or more sub-raw material was agglomerated. The agglomerated material was dried, and then charged and heated in a moving hearth-type reducing furnace for reducing the iron oxide in the material mixture with the carbonaceous reducing agent to obtain hot granulated metallic iron. The agglomerated material was formed into a pellet shape. The particle size ranged from 16 mm to 19 mm, and the average particle size was 17.5 mm.

The amount of the hot granulated metallic iron discharged from the moving hearth-type reducing furnace was 4.4 ton/h. The hot granulated metallic iron was charged into a rotary cooler (internal diameter: 1.37 m, descent: 1.2°) with a feeder and was then cooled. When the hot granulated metallic iron was charged into the cooler, water at a flow rate of 0.07 $m^3/h$ was poured to the hot granulated metallic iron at the inlet of the cooler so as to come into contact with the hot granulated metallic iron. The temperature of the hot granulated metallic iron at the cooler inlet was 860° C. The rotary cooler was rotated at 3.5 rpm.

The temperature of the granulated metallic iron at the cooler outlet, i.e., the temperature after cooling, was 58° C. The cross section of one grain of the resulting granulated metallic iron was examined with a scanning electron microscope at ×400 to confirm that a coating had been formed on the surface of the granulated metallic iron. The coating was analyzed by X-ray diffraction analysis to confirm that the component composition of the coating was magnetite and that the thickness was about 5 to 8 μm.

The cooling capacity per unit area of the external surface of the cooler calculated from the decrease in temperature in the cooler was 59.6 $kcal/m^2/h/°$ C.

Example 2

Hot granulated metallic iron was produced as in EXAMPLE 1 except that the pouring of water at the cooler inlet was not conducted. As a result, the temperature of the hot granulated metallic iron was 860° C. at the cooler inlet and was 109° C. at the cooler outlet.

The cross section of one grain of the resulting granulated metallic iron was examined with a scanning electron microscope at ×400 to confirm that the coating had not been formed on the surface of the granulated metallic iron.

The cooling capacity per unit area of the external surface of the cooler calculated from the decrease in temperature in the cooler was 35.1 $kcal/m^2/h/°$ C.

The granulated metallic iron produced in EXAMPLES 1 and 2 was left to stand outdoors for 1.5 months and then was visually examined the degrees of the occurrence of red rust. As a result, it was confirmed that the degree of the occurrence of the red rust in the granulated metallic iron produced in EXAMPLE 1 was less than that in the granulated metallic iron produced in EXAMPLE 2.

With regard to the cooling capacity of the cooler, the cooling capacity of the cooler used in EXAMPLE 1 was about 1.7 times larger than that of the cooler used in EXAMPLE 2. Therefore, the length of the cooler can be shortened to about 1/1.7 of the original by pouring water to the hot granulated metallic iron at the inlet of the cooler, as in EXAMPLE 1.

The invention claimed is:

1. A method for producing granulated metallic iron superior in rust resistance by agglomerating a material mixture including an iron-oxide-containing material and a carbonaceous reducing agent; charging and heating the agglomerated material mixture in a moving hearth-type reducing furnace to reduce the iron oxide in the material mixture with the carbonaceous reducing agent to obtain hot granulated metallic iron; and cooling the hot granulated metallic iron, wherein the hot granulated metallic iron is cooled while its relative position is changed; and an oxide coating is formed on the surface of the hot granulated metallic iron by bringing moisture into contact with almost the entire surface of the hot granulated metallic iron.

2. The method according to claim 1, wherein the hot granulated metallic iron is cooled while the direction of the hot granulated metallic iron is changed.

3. The method according to claim 1, wherein the oxide coating is formed of magnetite.

4. The method according to claim 1, wherein the hot granulated metallic iron is cooled in a cooler selected from the group consisting of a rotary cooler, an oscillating cooler, and a pan-conveying cooler.

5. The method according to claim 1, wherein moisture is brought into contact with the surface of the hot granulated metallic iron by pouring or jetting moisture from above the hot granulated metallic iron.

6. The method according to claim 1, wherein the oxide coating is formed on the surface of the hot granulated metallic iron at a temperature of 250° C. or more.

7. The method according to claim 1, wherein the amount of the moisture brought into contact with the hot granulated metallic iron is 15 kg or more per ton of granulated metallic iron.

8. The method according to claim 1, wherein the moisture brought into contact with the hot granulated metallic iron is vaporized water.

9. A method for producing granulated metallic iron superior in rust resistance by agglomerating a material mixture including an iron-oxide-containing material and a carbonaceous reducing agent; charging and heating the agglomerated material mixture in a moving hearth-type reducing furnace to reduce the iron oxide in the material mixture with the carbonaceous reducing agent to obtain hot granulated metallic iron; and cooling the hot granulated metallic iron, wherein the hot granulated metallic iron is cooled while its relative position is changed; and an iron oxide coating having an average thickness of 3 to 20 μm is formed on the surface, to cover 95% or more of the surface, of the hot granulated metallic iron by bringing moisture into contact with the surface of the hot granulated metallic iron.

10. The method according to claim 9, wherein the iron oxide coating is formed of magnetite.

11. The method according to claim 9, wherein the hot granulated metallic iron is cooled in a cooler selected from the group consisting of a rotary cooler, an oscillating cooler, and a pan-conveying cooler.

12. The method according to claim 9, wherein moisture is bought into contact with the surface of the hot granulated metallic iron by pouring or jetting moisture from above the hot granulated metallic iron.

13. The method according to claim 9, wherein the oxide coating is formed on the surface of the hot granulated metallic iron at a temperature of 250° C. or more.

14. The method according to claim 9, wherein the amount of the moisture brought into contact with the hot granulated metallic iron is 15 kg or more per ton of granulated metallic iron.

15. The method according to claim 9, wherein the moisture brought into contact with the hot granulated metallic iron is vaporized water.

* * * * *